US005246066A

United States Patent [19]

Morgan et al.

[11] Patent Number: 5,246,066

[45] Date of Patent: Sep. 21, 1993

[54] ONE PIECE EXTRUDED TANK

[75] Inventors: John P. Morgan, Cheektowaga; Ralph J. Honey, Randolph, both of N.Y.

[73] Assignee: General Motors Corporation, Detroit, Mich.

[21] Appl. No.: 891,080

[22] Filed: Jun. 1, 1992

[51] Int. Cl.[5] ..... F28F 9/02

[52] U.S. Cl. ..... 165/173; 165/153

[58] Field of Search ..... 165/153, 173; 29/890.052

[56] References Cited

U.S. PATENT DOCUMENTS

| | | | |
|---|---|---|---|
| 4,825,941 | 5/1989 | Hoshino et al. | 165/110 |
| 4,960,169 | 10/1990 | Granetzke | 165/173 |
| 5,009,262 | 4/1991 | Halstead et al. | 165/140 |
| 5,052,478 | 10/1991 | Nakajima et al. | 165/153 |
| 5,069,277 | 12/1991 | Nakamura et al. | 165/173 |
| 5,076,354 | 12/1991 | Nishishita | 165/146 |
| 5,107,926 | 4/1992 | Calleson | 165/173 |

*Primary Examiner*—Allen J. Flanigan

*Attorney, Agent, or Firm*—Patrick M. Griffin

[57] ABSTRACT

A heat exchanger includes two parallel tank units each providing a fluid space therein and supporting a core therebetween. The core includes parallel tube passes connected between the tank units, and air centers connected between the tube passes for conductive heat transfer with air flowing therethrough. The tank units include tube slots therein for receiving the ends of the tube passes in fluid communication with the fluid space. The ends of the tube passes are arcuate in configuration to allow optimum flow of fluid within the fluid space.

1 Claim, 2 Drawing Sheets

ONE PIECE EXTRUDED TANK

TECHNICAL FIELD

The invention relates to a heat exchanger apparatus and a method of forming a heat exchanger which exchanges heat between engine fluid of a motor vehicle and air, the heat exchanger being of the type including parallel tube passes and air centers for directing the inlet air stream of the vehicle through separate tube passes in the heat exchanger.

BACKGROUND OF THE INVENTION

Motor vehicle heat exchangers for cooling engine coolant, refrigerant vapor and transmission oil are known. Most heat exchangers are comprised of a separate header and tank which are clamped to one another and brazed for sealing same. One type of heat exchanger is illustrated in U.S. Pat. No. 4,945,635 which discloses a method of making brazable pipes and heat exchanger. The tank is formed by rolling a brazing sheet into a cylinder with opposite ends being butt jointed to each other by brazing. Slots are provided in the tank for receiving the tube passes therein which communicate the engine fluid between the parallel tanks.

Granetzke U.S. Pat. No. 4,960,169 issued Oct. 2, 1990 discloses a baffle for a tubular heat exchanger header. The tanks are formed as essentially cylindrical tubes with slots formed therein to receive the plurality of parallel tube passes extending between the tanks.

Halstead et al U.S. Pat. No. 5,009,262 issued Apr. 23, 1991, and assigned to the assignee of the subject invention, discloses a combination radiator and condenser heat exchanger for a vehicle. The heat exchanger includes a pair of tanks formed of a unitary extrusion with tube passes in fluid communication between the tanks.

In all the prior art patents, the ends of the tube passes are cutoff in a straight, rectangular configuration.

SUMMARY OF THE INVENTION

The invention includes a heat exchanger apparatus of the type having a pair of tank units supporting a core therebetween. The core comprises a plurality of parallel tube passes with air centers bonded therebetween for conductively exchanging heat with air flowing therethrough. The tank units include a fluid space communicating with the tube passes and include an integral header portion having a plurality of longitudinally spaced apertures therein aligned with the tube passes for receiving the ends thereof. The tube passes comprise flat sided extruded tubes having fluid flow passages extending therethrough between first and second ends open to the fluid space. The open ends are of arcuate formation for allowing maximum flow through said fluid space.

The invention also includes a method of forming the above heat exchanger. The method includes the steps of extruding a unitary tank with the fluid space therethrough, piercing a side of the unitary tank forming open slots to the fluid space spaced longitudinally along the side, inserting extruded tubes in each of the slots. Also included is the step of extruding a plurality of tube passes, cutting off the ends of the tube passes forming arcuate open ends, and inserting extruded tubes in each of the slots with the arcuate ends extending therein allowing flow through the fluid space.

BRIEF DESCRIPTION OF THE DRAWINGS

Advantages of the subject invention will become readily appreciated as the same becomes better understood when taken in conjunction with the accompanying drawings wherein.

DETAILED DESCRIPTION OF THE PREFERRED EMBODIMENT

Figure 1:
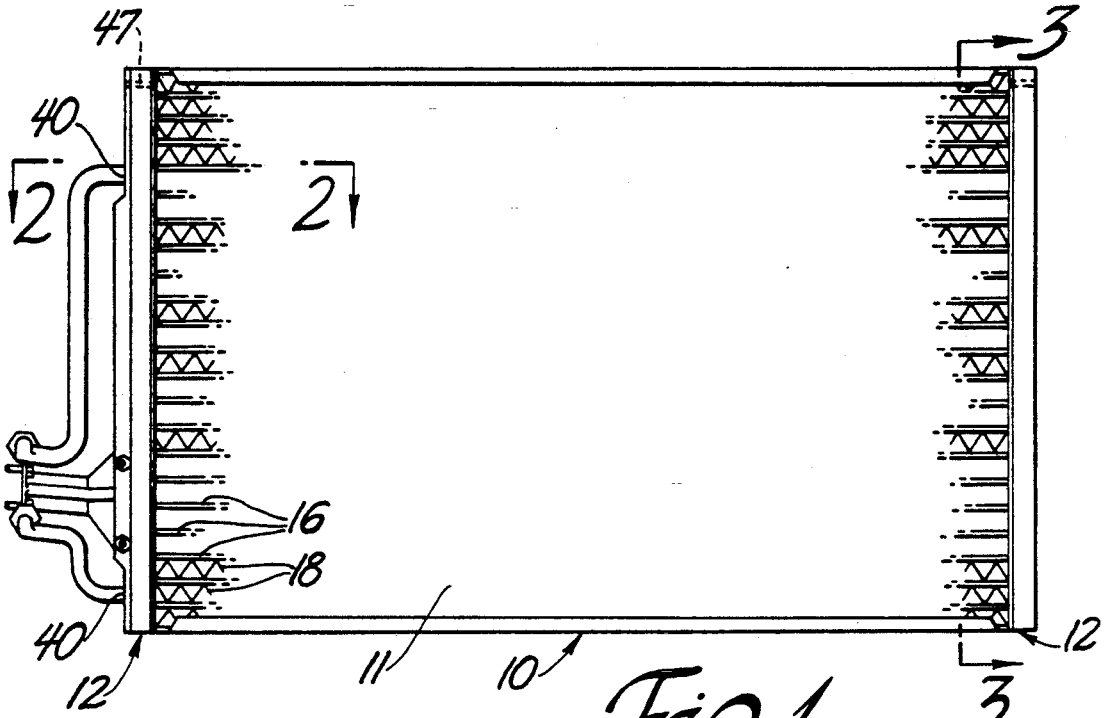
FIG. 1 is an enlarged front elevational view of the heat exchanger of the subject invention.

A heat exchanger 10 of the subject invention is generally illustrated in FIG. 1. The heat exchanger 10 includes a pair of tank units 12 each having a fluid space 14 therein for containing heat exchanger fluid such as engine coolant. In the preferred embodiment, the heat exchanger is utilized as a radiator for a vehicle of the type having a liquid cooled engine. Alternatively, the heat exchanger 10 can be a condenser for cooling refrigerant the refrigerant circuit of a HVAC (heating, ventilating, and air conditioning) system. However, it is to be understood that the heat exchanger described herein may be used in other types of heat exchange environments.

The heat exchanger 10 also includes a core 11. The core 11 includes a plurality of parallel tube passes 16 extending between the pair of tanks 12 in fluid communication with the fluid spaces 14. Air centers 18 are connected between the tube passes 16 for directing the inlet air stream of the vehicle through the tube passes 16 to conductively cool the fluid therein in the case of the fluid being coolant and in the case that the fluid is refrigerant flow through a condenser.

Figure 2:
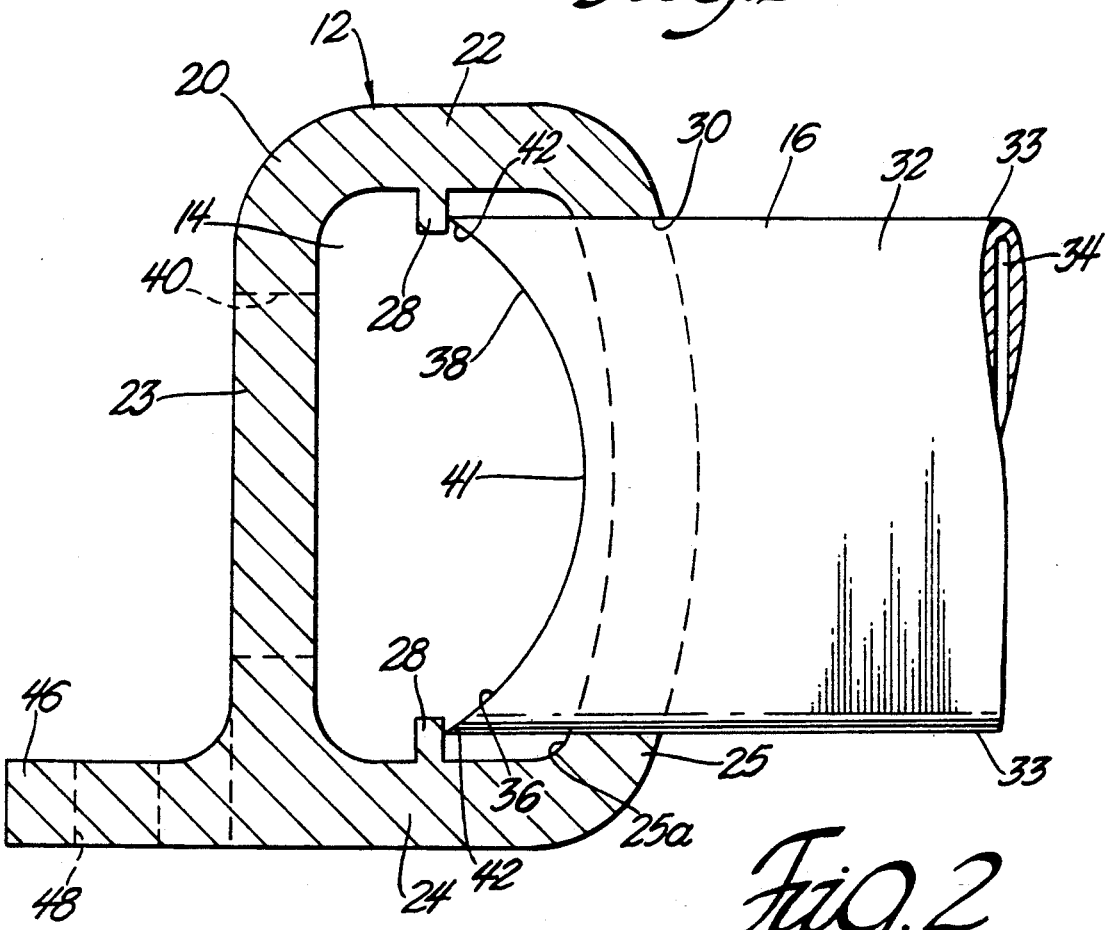
FIG. 2 is an enlarged cross-sectional view taken along lines 2—2 of FIG. 1.

As best illustrated in FIG. 2, each tank unit 12 comprises a unitary extruded tank 20 providing the fluid space 14 therethrough. The unitary extruded tank 20 forms four solid longitudinal side walls 22, 23, 24, 25. Three of the walls 22, 23, 24 are generally flat sided, with the first 22 and third 24 walls perpendicular to the second wall 23. The fourth wall 25 is formed as an arc or curvature bowing outwardly from the fluid space 14. The first 22 and third 24 walls include tube stops 28 integral therewith and projecting into the fluid space 14. The tube stop 28 provides a stop for the tube passes 16, as subsequently discussed.

Figure 3:
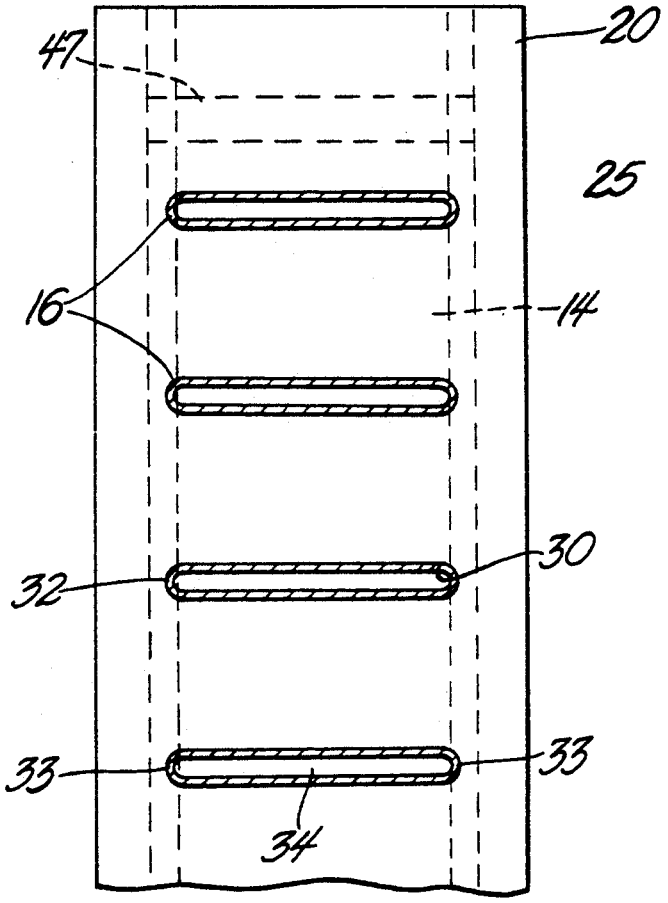
FIG. 3 is an enlarged sectional view of the header side of the subject invention taken along lines 3—3 of FIG. 1.

After the tank 12 is extruded having a continuous, solid arcuate wall 25, tube slots 30 are formed therein. The tube slots 30 are formed by piercing the wall 25 with a punch or die. Such piercing or punching may be accomplished in manner as commonly known in the art for forming openings in extrusions. The tube slots 30 are spaced longitudinally along the header or fourth side wall 25, as best illustrated in FIG. 3. The tube slots 30 are elongated transverse to the longitudinal axis through the tank 12. Furthermore, the tube slots 30 are aligned with the tube stops 28 to allow the tube passes 16 to be inserted within the tube slots 30 and abut the tube stops 28.

The tube passes 16 are comprised of flat sided extruded tubes 32 having fluid flow passages 34 extending therethrough between first and second open ends 36. The extruded tubes 32 provide rounded edges 33 between the flat sides and extend longitudinally between the ends 36. The extruded tubes 32 may have a plurality of flow paths or a single flow path 34 therethrough, as commonly known in the art. The extruded tubes 32 may be made of a material similar to that of the tank 12.

In accordance with the present invention, the ends 36 of the tube extrusions 32 are cut along an arcuate path 38 having its center 40 located on the longitudinal center of the tubes 32. The ends 42 of the arc 38 at the rounded edges 33 of the tube 32 define an axial length to the slots 30 that is greater than the axial distance from the ends 42 to the center 41 of the arc. In other words, when the tubes 32 are inserted within the slots 30, the edges 33 of the extruded tubes 32 will extend into the fluid space 14 further than the center 40 of the arc. This allows uninhibited and optimum flow of the fluid within the fluid space 14 of the tank 12. Furthermore, the curved or arcuate cutoff ends 36 allow minimum package size by allowing a decrease in fluid space depth. The arc 38 of the tubes 32 has a smaller radius then that of the arc forming the fourth side 25 of the tank 20 so as to increase flowability at the inner surface 25*a* of the fourth side 25.

The extruded tank 12 and tubes 32 are formed of a suitable aluminum alloy material, such as 3003 aluminum alloy. The outside surface of the header portion or wall 25 may be sprayed with a suitable clad material to allow brazing of the tube passes 16 thereto. The material of the extrusion is only illustratively included herein with it being understood that other extrudable materials are contemplated within the invention as set forth in the appended claims. The coating may be anyone of plasma 4343, 4045, 4047 silicon aluminum alloy of a thickness from 3 to 10% of the header wall thickness.

The tanks 12 may include apertures 40 therein for receiving inlet and outlet pipe fittings in the side walls 23 thereof to communicate either coolant hoses or refrigerant hoses with the fluid space. Such fitting are commonly known in the art. Both the inlet and outlet apertures and fittings 40 are located on the same tank in the case of an even number of passes of the fluid through the core 11, such as two passes. The inlet and outlet apertures and fittings are connected on opposite tanks 12 as illustrated in FIG. 1, in the case of an odd number of passes system, such as a single pass system in the case of connections for hoses in an engine coolant system.

In the case of multiple pass systems, a divider or partition (not shown) may be inserted within the tank 20 and are of clad material, as commonly known in the art. The assembly 10 is thereafter brazed to seal the clad joints.

End closures 47 are inserted in the ends of the extruded tanks 20 to close the open ends of the fluid spaces 14. The end closures 47 are press fit into the ends of the tanks 32 and include clad material for sealing same during brazing thereof. The end closures 47 may be of the same configuration as set forth in Halstead et al U.S. Pat. No. 5,009,262 issued Apr. 23, 1991 and having a common assignee of the subject invention, and that is incorporated by reference herein.

The invention includes a method of making a heat exchanger which includes the steps of directing an extrudable material through an extruding die, shaping the extruding die to form the elongated hollow member 20 having open ends, closing the ends of the hollow member by applying hydraulic pressure to the chamber to form a support for the header wall 25, piercing a plurality of tube slots 30 in the header wall 25. Thereafter, the plurality of tubes lengths 32 are cut in the arcuate form and inserted into the tube slots 30 to abut the tube stops 28. The end closures and partitions are inserted. The system is brazed to seal the joined parts.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A heat exchanger apparatus of the type having a pair of tank units supporting a core therebetween, the core comprising a plurality of parallel tube passes with air centers bonded therebetween for conductively exchanging heat with air flowing therethrouqh, said tank units including a fluid space communicating with the tube passes and also including an arcuate wall having a predetermined radius having a plurality of longitudinally spaced tube slots therein aligned with said tube passes for receiving the ends thereof, the improvement comprising:

the tube passes comprising extruded tubes having fluid flow passages extending therethrough between first and second ends open to said fluid space and providing edges extending longitudinally between said ends, said open ends having an arcuate shape between said edges for allowing maximum flow through said fluid space;

said arcuate shape having a radius less than the radius of said tank unit arcuate wall.

* * * * *